United States Patent [19]

Aspin

[11] 4,033,317

[45] July 5, 1977

[54] INTERNAL COMBUSTION ENGINES

[75] Inventor: Frank Metcalf Aspin, Knutsford, England

[73] Assignee: Aspin Power Limited, England

[22] Filed: June 4, 1975

[21] Appl. No.: 583,528

[30] Foreign Application Priority Data

June 5, 1974 United Kingdom ..... 24865/74

[52] U.S. Cl. ..... 123/190 D; 123/75 B; 123/191 S

[51] Int. Cl.[2] ..... F01L 7/00

[58] Field of Search ..... 123/325 P, 191 R, 191 S, 123/191 SP, 80 D, 190 B, 190 D, 30 C, 32 B, 75 B

[56] References Cited

UNITED STATES PATENTS

| | | | |
|---|---|---|---|
| 1,427,726 | 8/1922 | Echard | 123/190 D |
| 2,331,801 | 10/1943 | Rodgers | 123/190 D |
| 2,377,336 | 6/1945 | Frank | 123/190 D |
| 2,522,921 | 9/1950 | Barkeij | 123/191 R |
| 3,079,901 | 3/1965 | Hallberg | 123/32 SP |
| 3,182,645 | 5/1965 | Wilson | 123/191 R |
| 3,526,215 | 9/1970 | Aspin | 123/190 D |

*Primary Examiner*—C. J. Husar
*Assistant Examiner*—David D. Reynolds
*Attorney, Agent, or Firm*—Oblon, Fisher, Spivak, McClelland & Maier

[57] ABSTRACT

There is disclosed an internal combustion engine within which is defined at least one cylinder accommodating a reciprocable piston, and within which is disposed a valve rotor mounted at the compression end of the or each said cylinder for rotation about the longitudinal axis of the cylinder and having a number of passages therethrough each extending between the cylinder interior and a portion of the structure having inlet and exhaust ports, to allow for conventional fourstroke operation with said valve rotor rotating at an appropriate fraction of crank-shaft speed, the construction being such that at top dead center following a compression stroke each passage forms a substantially independently enclosed combustion space at the compression end of the cylinder adjacent the crown of the piston. The internal contours of the passages are such as to cause a rapid swirling motion of gases admitted thereto from the ports or the cylinder and such as to propagate combustion of a fuel charge therein in a controlled and even manner when an ignition spark occurs adjacent the boundary of a combustion space remote from the piston crown after a compression stroke. Particular combustion space contours are disclosed; also phased ignition, different combustion space volumes, and different inclinations of inlet passages to direct air to the cylinder wall and an air and fuel mixture to the inner part of the cylinder. Also disclosed is throttle control means for varying the air-fuel ratio and cooling means for maintaining the surfaces of the combustion spaces at about two-thirds the temperature of the piston crown. The internal combustion engine is very suitable for an automobile powered by gasoline.

12 Claims, 11 Drawing Figures

INTERNAL COMBUSTION ENGINES

This invention concerns internal combustion engines of the kind incorporating rotary valve means for controlling inlet and exhaust functions, the valve means being shaped to provide the major portion of the combustion volume at maximum compression.

It is the object of the present invention to improve the characteristics of an internal combustion engine of the kind of which reference has just been made, especially such an engine fueled by gasoline for an automobile.

According to the present invention, an internal combustion engine comprises a structure within which is defined at least one cylinder accommodating a reciprocable piston, and within which is disposed a valve rotor mounted at the compression end of the or each said cylinder for rotation about the longitudinal axis of the cylinder and having a number of passages therethrough each extending between the cylinder interior and a portion of the structure having inlet and exhaust ports, to allow for conventional four-stroke operation with said valve rotor rotating at an appropriate fraction of crank-shaft speed, the construction being such that at top dead centre following a compression stroke each passage forms a substantially independently enclosed combustion space at the compression end of the cylinder adjacent the crown of the piston.

In one embodiment means are provided so disposed that at the appropriate times an ignition spark is generated adjacent the boundary of each combustion space remote from the piston crown, and the internal contours of the passages are such that admission of gases thereto from the ports or the cylinder is accompanied by a rapid swirling motion, and such that propogation of combustion within each combustion space is controlled and even.

In the currently preferred embodiment of the present invention the valve rotor has two similar and diametrically opposed passages through a frusto-conical portion, and there are two inlet ports and two outlet ports in a cylinder block which partially surrounds the valve rotor. Means may be provided for supplying air only through one inlet port and a fuel and air mixture through the other inlet port. The passage leading to the inlet port to which air only is fed is inclined so as to direct the air through the valve rotor to the cylinder walls whereas the passage leading to the other inlet port is inclined so as to direct the fuel and air mixture through the valve rotor to the inner part of the cylinder. Whilst the timing arrangements will often be such that ignition occurs at top dead centre, the ignition in the two combustion spaces may be phased. Alternatively or additionally the volumes of the two combustion spaces may be different, as is later described.

Cooling will be provided for and it is preferred that the surfaces of the combustion spaces be maintained so far as possible at about two-thirds the piston crown temperature. Also it is preferred to provide a throttle control derived for example from the inlet manifold pressure which causes the air-fuel ratio to vary according to load conditions to achieve fuel economy and reduction in unburnt hydrocarbons. By this means, on over-run, virtual fuel cut-off can be obtained.

The invention will now be described further, by way of example, with reference to the accompanying drawings, in which, FIG. 1 is a sectional view through a single cylinder gasoline-fuelled internal combustion engine showing the general construction according to the invention, FIG. 2 is a sectional side elevation of a cylinder, piston and valve rotor arrangement of one such engine constructed according to the invention, the section being taken transversely to the crank-shaft;

Figure 1:
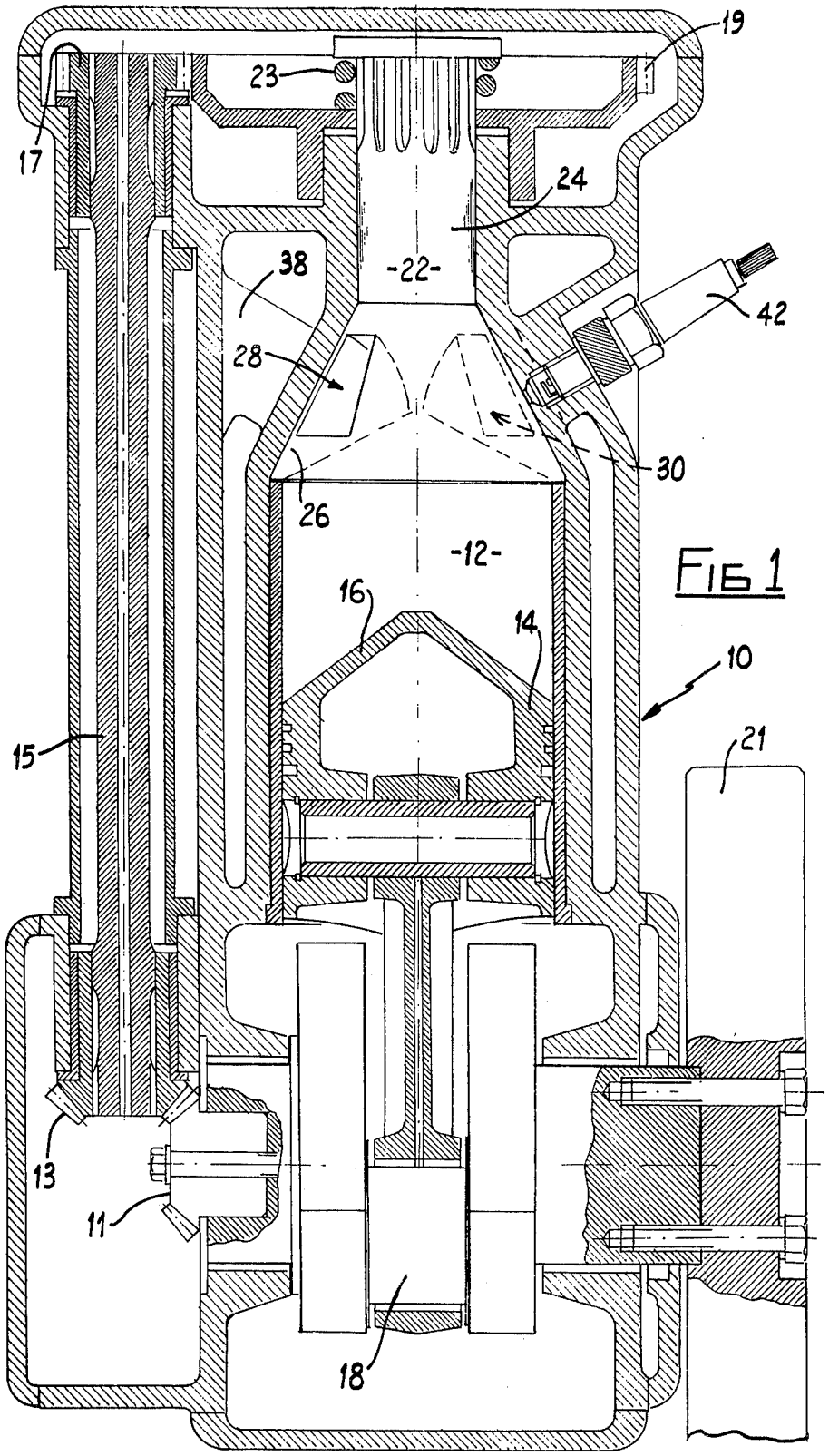

It should first be noted, with reference to the accompanying drawings, that they are intended to illustrate adequately the important and essential features of the invention, rather that to show in full and accurate detail the various parts. With this end in view a single cylinder embodiment is shown (the invention is obviously applicable to multi-cylinder engines); certain ancilliary parts such as the valve driving gear are not shown in most Figures; and in some sectional views the line of the section is somewhat complicated with the object of showing the various parts to the best advantage.

Reference is first made to FIGS. 1 to 5.

A structure generally indicated by the reference numeral 10 defines a cylinder 12, within which is disposed a piston 14 having a frusto-conical crown 16. The piston 14 is reciprocable within the cylinder 12 and transmits power to a crankshaft 18 via a connecting rod 20. Also within the structure 10 is disposed a valve rotor 22 having a stem 24 and a frusto-conical skirt 26 with two diametrically opposed passages 28, 30 through the wall thereof. The shape of the skirt 26 and the passages 28, 30 will be described in greater detail hereinafter. The valve rotor 22 is mounted for rotation under the influence of compression spring 23 so that the outer surface of the skirt 26 is in sealing contact with a complementary frusto-conical surface within the structure 10. There are two inlet ports proper and two exhaust ports proper in the latter surface with inlet and exhaust passages connecting these inlet ports to fuel and air supply means (not shown). For convenience the respective ports proper and passages will be referred to compendiously as two inlet ports 32,34 and two exhaust ports 36,38. The structure 10 also supports two sparking plugs 40,42.

For the sake of a fuller disclosure of the general structure there is shown, in FIG. 1 only, the driving means for the valve rotor 22. A bevel gear 11 is supported in the end of the crank-shaft journal, and this gear 11 is in mesh with a further bevel gear 13 on the lower end of a floating shaft 15. The upper end of the shaft 15 carries a spur gear 17 which meshes with gear teeth 19 on the valve rotor 22. The gear ratio of the valve rotor drive is such that the valve rotor rotates at one quarter the crank-shaft speed.

The crank-shaft carries a conventional fly wheel 21.

Figure 2:
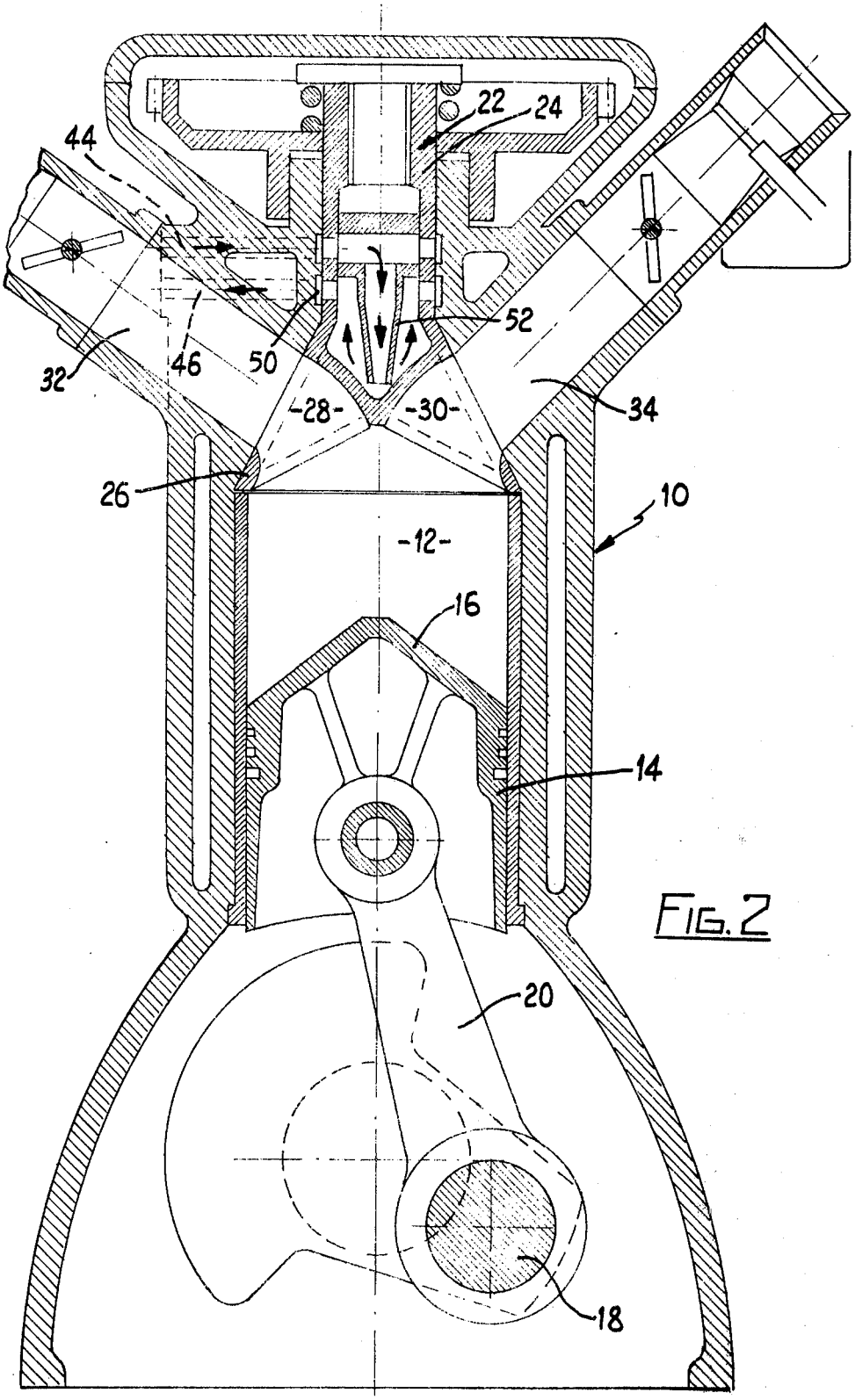
Figure 4:
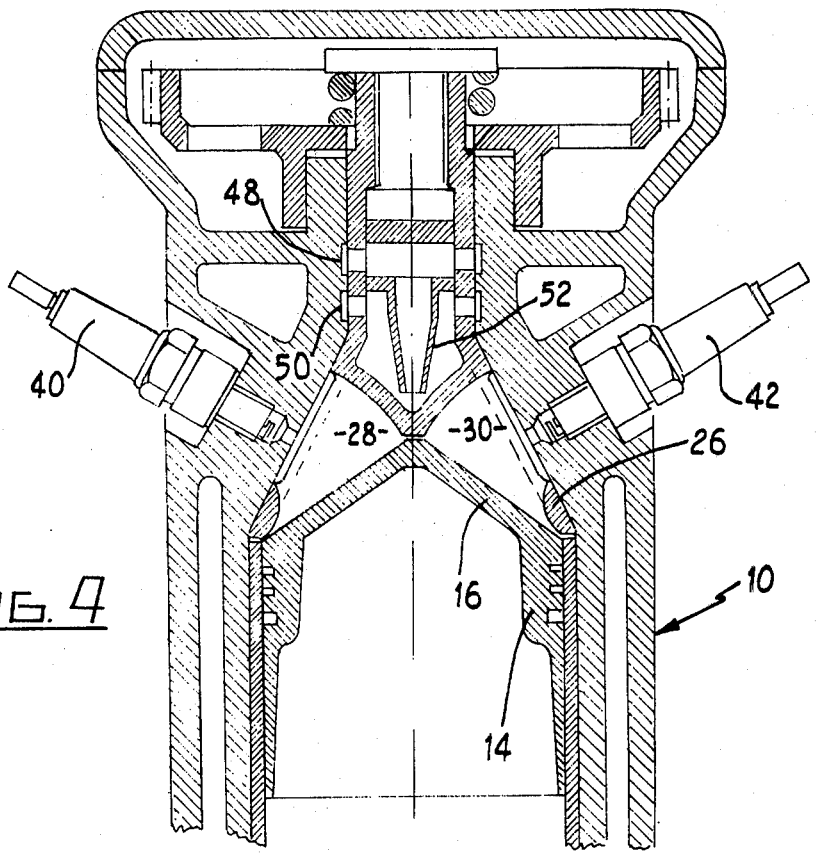
FIG. 4 is a sectional elevation on the line IV—IV of FIG. 3.
Figure 5:
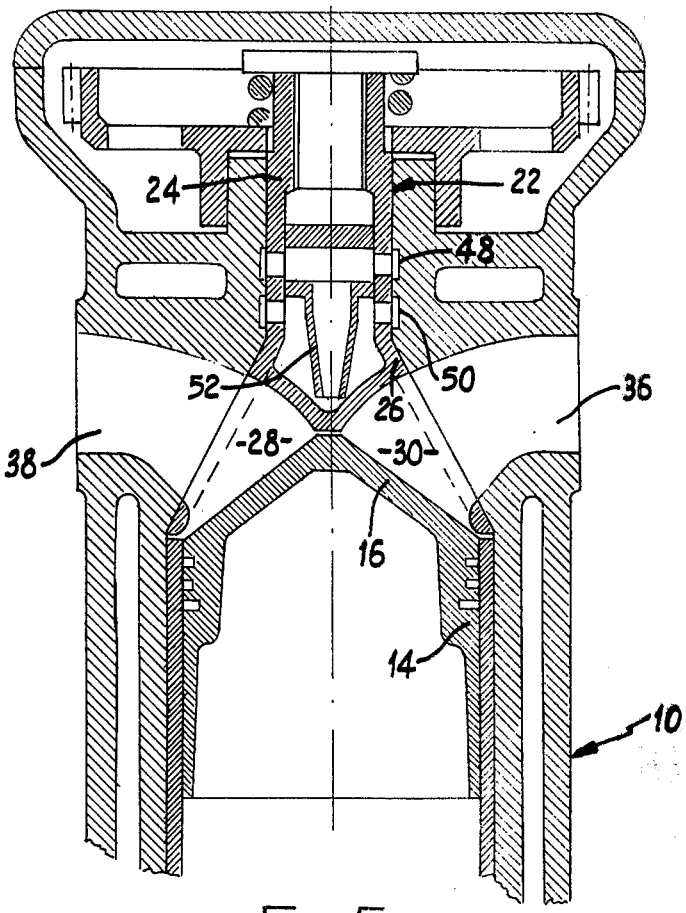
FIG. 5 is a sectional view on the line V—V of FIG. 3 but with the valve rotor in the position appropriate to T.D.C. (top dead centre) following an exhaust stroke, that is, with the passages in the rotor about to move out of register with the exhaust ports, and already partly in register with the inlet ports.

Referring to FIGS. 2, 4, 5 there may be seen means for force cooling the valve rotor 22. Inlet and outlet passages 44, 46 for cooling fluid (which will normally be water), are provided in the structure 10, terminating in annular headers 48,50 which facilitate the passage of the fluid into (via a fish-tail nozzle 52) and out of the hollow interior of the valve rotor 22 as indicated by the arrows in FIG. 2.

As has already been explained, a single cylinder engine is being described for the sake of simplicity. Usually engines according to the invention will be multi-cylinder engines, as for example automobile engines. In this case the other valve rotors may be directly geared in series with the rotor driven from shaft 15, or, preferably, in order to avoid complications due to rotors rotating in opposite senses, all the rotors are driven from a common shaft, driven from shaft 15, as through bevel gears.

It will be noted that the inlet ports 32,34 have different inclinations. This is preferred, for reasons set out later, but the ports could have the same inclination.

The shape of the skirt 26 and the passages 28, 30 is of importance. As has already been said, the outer surface of the skirt 26 is complementary to, and moves in sealing contact with, a surface within the structure 10. The inner surface of the skirt 26 is complementary to the shape of the piston crown 16. The passages 28, 30 commence at the outer surface of the skirt 26 with a trapezium cross-sectional shape and terminate at the inner surface of the skirt 26 with a substantially circular cross-sectional shape (in both cases viewed normally to the respective surface). Internally each passage 28, 30 is contoured to encourage two characteristics in particular. The first is a rapid swirling motion of the inlet gas, or mixture, always in the same sense, as the inlet ports are progressively opened and the mixture admitted to the passages, followed by a smooth and direct admission of the mixture of the cylinder; and a smooth and direct admission of the mixture to the passages on compression after the inlet ports are closed, again with a rapid swirling motion. The second is the controlled and even propogation of combustion of the charge compressed in the passages at the region of top dead centre. The passage walls, with these ends in view, are smoothly curved to provide a maximum cross-sectional dimension at the breakthrough of the respective passage at the inner surface of the skirt, and a minimum cross-sectional dimension at the commencement of the respective passage at the outer surface of the skirt. In the embodiment being described the axis of each passage lies in the same diametral plane of the skirt 26.

Figure 3:
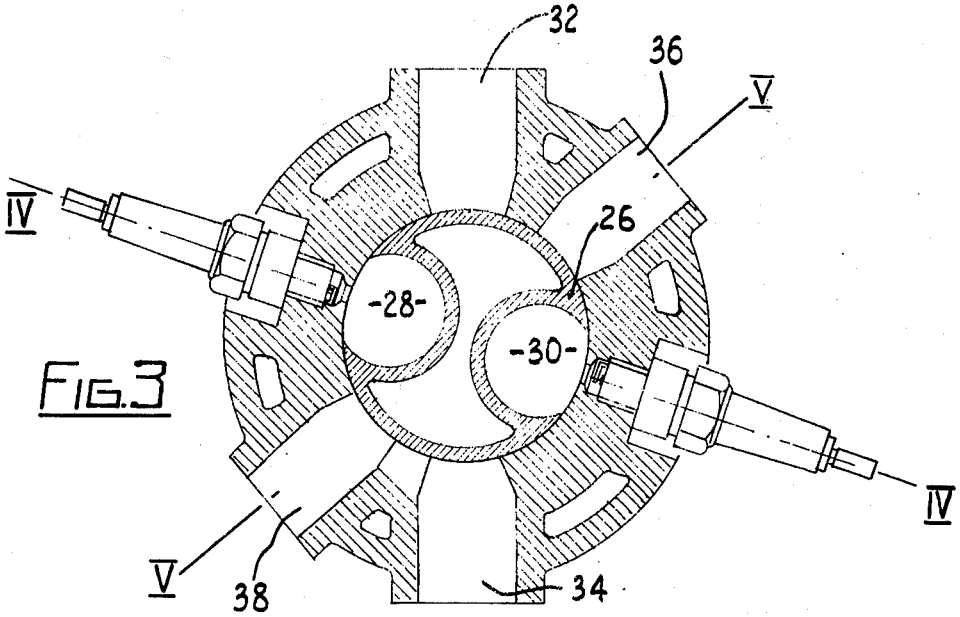
FIG. 3 is a sectional plan view of the arrangement of FIG. 2, showing the valve rotor, inlet and exhaust ports, and sparking plugs.

In operation, the valve rotor 22 is driven, as has been stated, at one quarter the crank-shaft speed, and with the valve rotor 22 rotating counter-clockwise in FIG. 3 it will be clear how the two complete working cycles per revolution of the valve rotor 22 proceed. In particular it will be noted that at top dead centre on completion of a compression stroke (FIG. 4) substantially the whole of the combustion space is defined within the passages 28,30. As a result of the design of the valve rotor 22 and its relationship with the ports 32,34,36,38 the engine has good characteristics. Very high compression ratios are possible without detonation, lean mixtures especially being capable of being burnt at high pressure. Excessively high temperatures do not occur. If both sparking plugs are fired at the same time maximum power-and thus lowest fuel consumption - is achieved. By suitably phasing the firing of the plugs maximum pressure is reduced and this has a tendency to reduce residual oxides of nitrogen. The cooling system is designed to maintain the combustion space surface temperatures in the region of two-thirds of the piston crown temperature.

Figure 6:
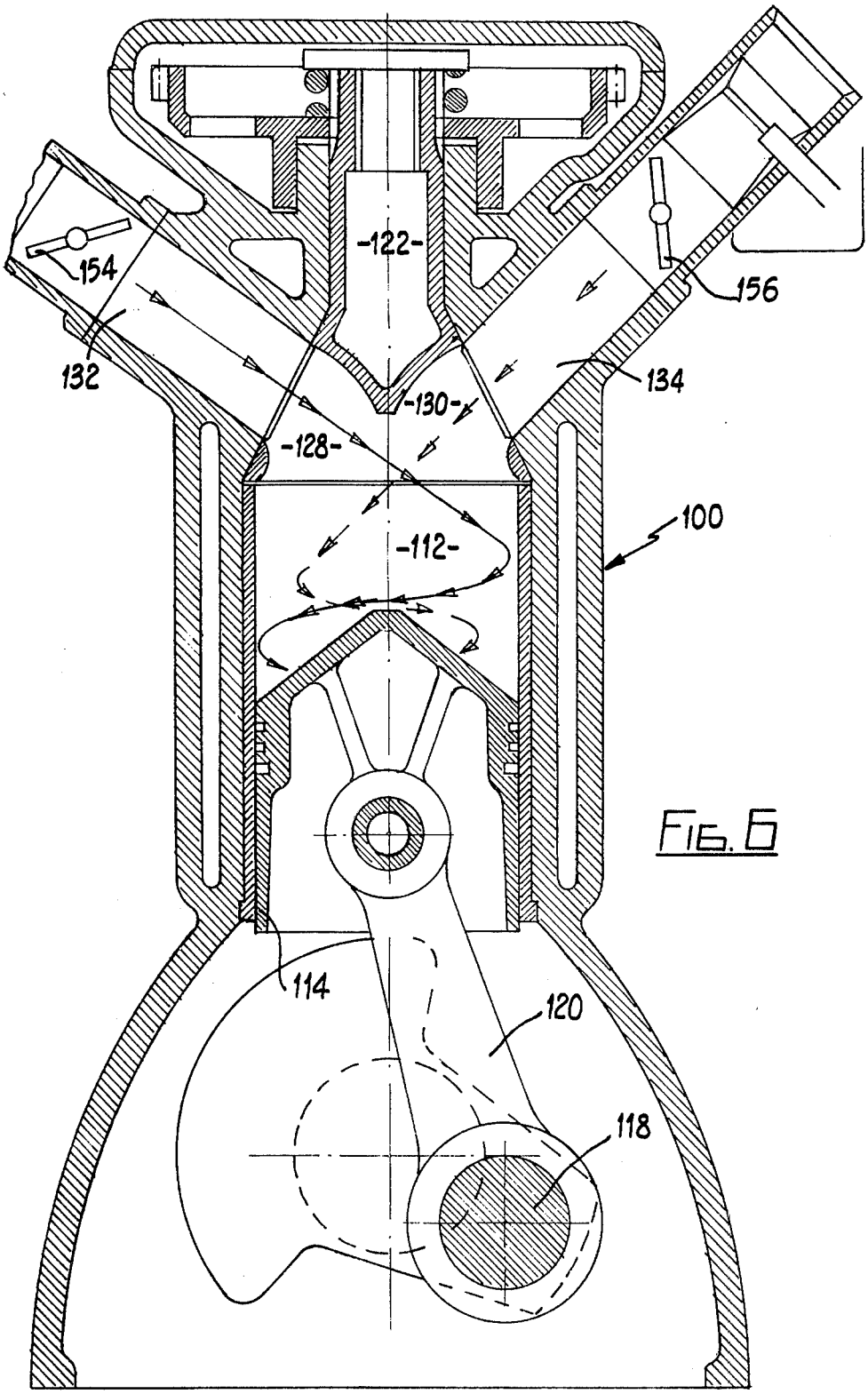
FIG. 6 is a sectional side elevation similar to FIG. 2 with certain parts omitted for the sake of clarity, and illustrating the manner of induction of fuel and air.
Figure 7:
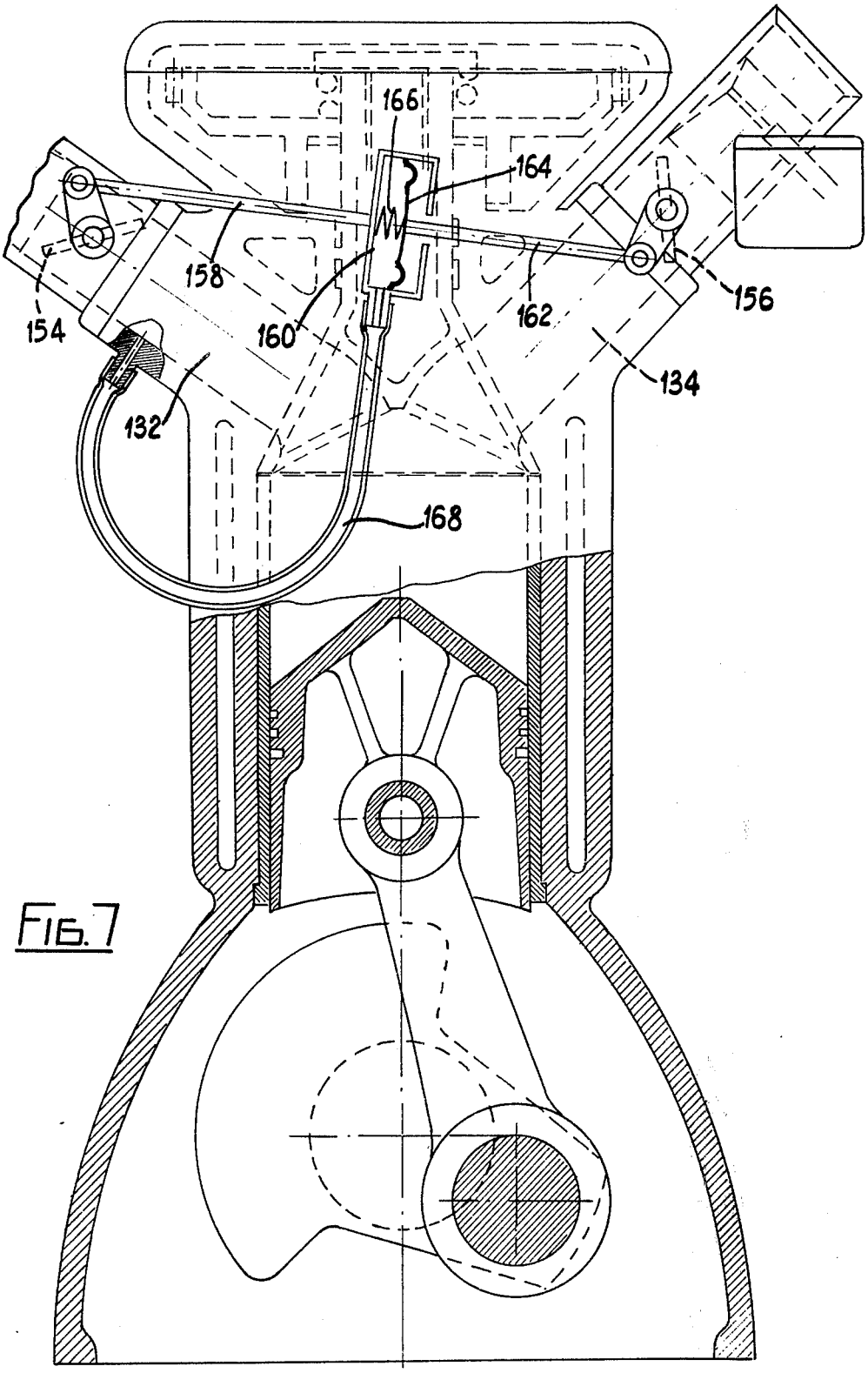
FIG. 7 is a part-sectional view corresponding to FIG. 6, showing especially the throttle control arrangements.
Figure 8:
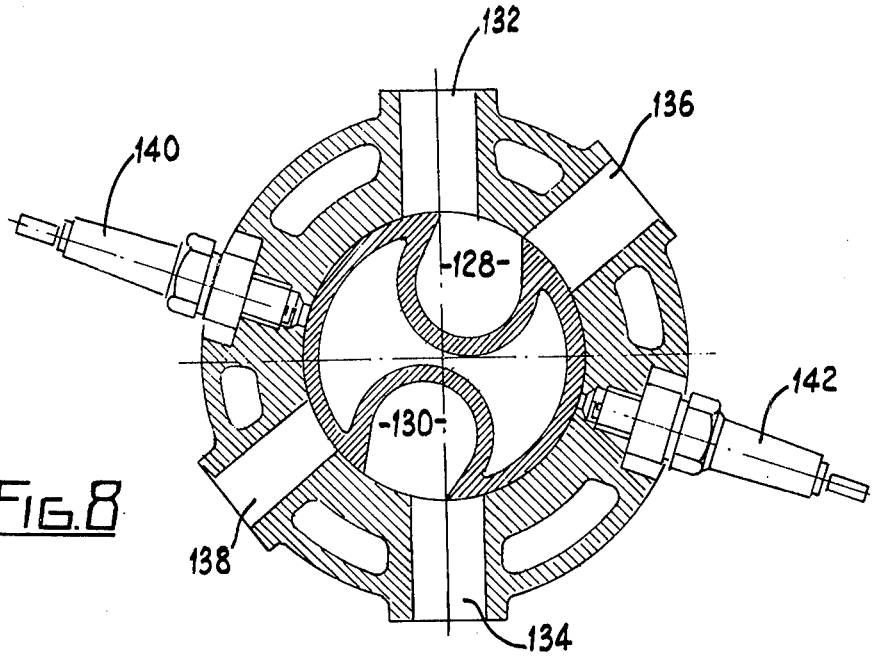
FIG. 8 is a sectional plan view of the arrangement of FIGS. 6 and 7 showing the relationship of the valve rotor and the inlet and exhaust ports at T.D.C. following an exhaust stroke of the piston.

In FIGS. 6 to 9 the construction of the modified forms of engine shown is basically similar to the form illustrated in FIGS. 1 to 5 and therefore the same reference numerals increased by 100 have been used for the corresponding parts. As far as the embodiment illustrated in FIGS. 6 to 8 is concerned the inlet ports 132,134 have their axes in the vertical plane and they are downwardly inclined at different angles. Furthermore it is arranged that the inlet port 132 is supplied with air only whilst the inlet port 134 is supplied with a rich fuel and air mixture. The respective inclinations are such that the air admitted from inlet port 132 is directed towards the walls of the cylinder 112 whilst the air and fuel admitted from inlet port 134 is directed towards the inner part of the cylinder 112. As a result the inducted charges tend to follow the respective paths indicated by the arrows in FIG. 6. This has beneficial results. In the first place, because there is less tendency for the fuel to contact the cylinder walls, there is a reduction in unburnt hydrocarbons. Secondly the mass of swirling, relatively stratified, components of the inducted charge is, during compression as the cycle proceeds, progressively "flattened" and as a result the speed of its whirling motion is increased. Observation indicates that there is a continually increasing tendency for the fuel component to move radially outward of the cylinder 112 and for it to lead the air component upwardly of the cylinder. Consequently the richer part of the charge reaches the ignition region earlier, which facilitates the use of leaner overall mixtures, and the following part of the charge, containing more air, facilitates more complete combustion. All in all there is better fuel utilization and a reduction in pollutants.

Figure 9:
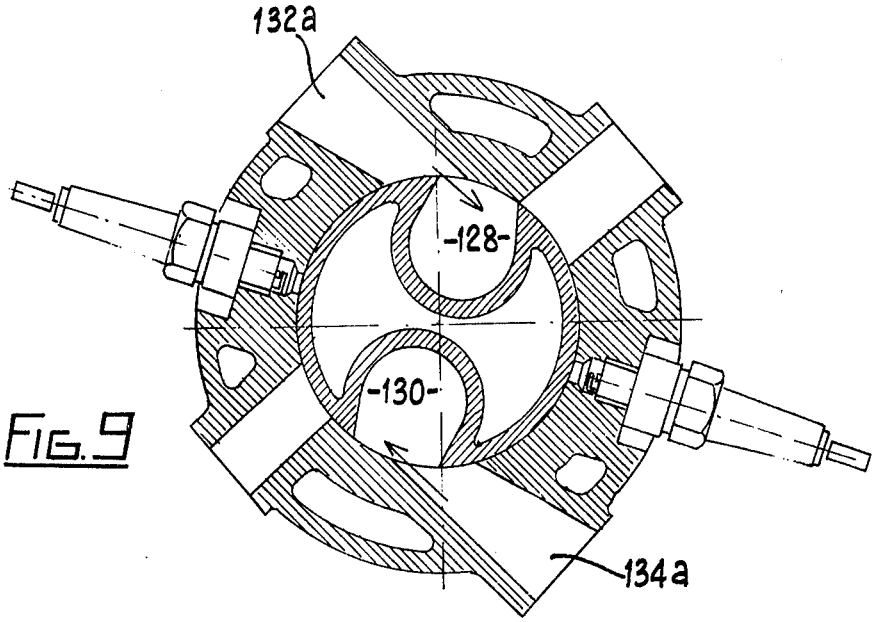
FIG. 9 is a sectional plan view similar to that of FIG. 8 but illustrating modified inlet ports.

Turning now in FIG. 9, the inlet ports 132*a* and 134*a* are additionally inclined to the diametral plane of the valve rotor 122 and relative to radial directions thereof so as to assist in the creation of the swirling motion of the inducted charge both in the passages 128,130 and in the cylinder 112.

In the embodiments of the invention described with reference to FIGS. 6 to 9 we prefer to provide biased throttle control for the supply of air and of fuel and air to the respective inlet ports 132, 134, 132*a*, 134*a*. The biasing is such that although the throttles 154,156 exert equal impedance on opening and at maximum opening, at lower openings when the engine is "on top" of the load, proportionately more air is allowed in, to give a leaner mixture, with consequent further improvement in fuel consumption. It is also preferred, as shown in FIG. 8, for there to be no overlap of the valve opening as far as the air-fuel inlet port 134, 134*a* is concerned and the preceding exhaust port. All scavenging therefore is without fuel loss.

FIG. 7 illustrates one suitable arrangement for biasing the throttle control. The two throttles 154,156 are connected, externally of the structure 100, by a split rod, one part 158 of which terminates in a diaphragm box 160, and the other part 162 of which is connected to a diaphragm 164 mounted in the box 160. A suitably rated compression spring 166 urges the box 160 and the diaphragm 164 (and therefore the rod parts 158,162) apart. The space between the diaphragm 164 and the walls of box 160 is connected, by means of a pipe 168 to the inlet port 132. In operation the fuel and air throttle 156 is the master throttle. On acceleration of the vehicle from rest the depression in the box 160 is a minimum so that the rod parts 158, 162 are at maximum separation and both throttles 154,156 open together to give a rich, maximum power mixture. As the load is taken up by the engine the depression increases and the effective length of the connection between the throttles is reduced and the air admission under control of throttle 154 is increased relative to the air and fuel admission under the control of throttle 156 to give a leaner overall mixture.

Figure 10:
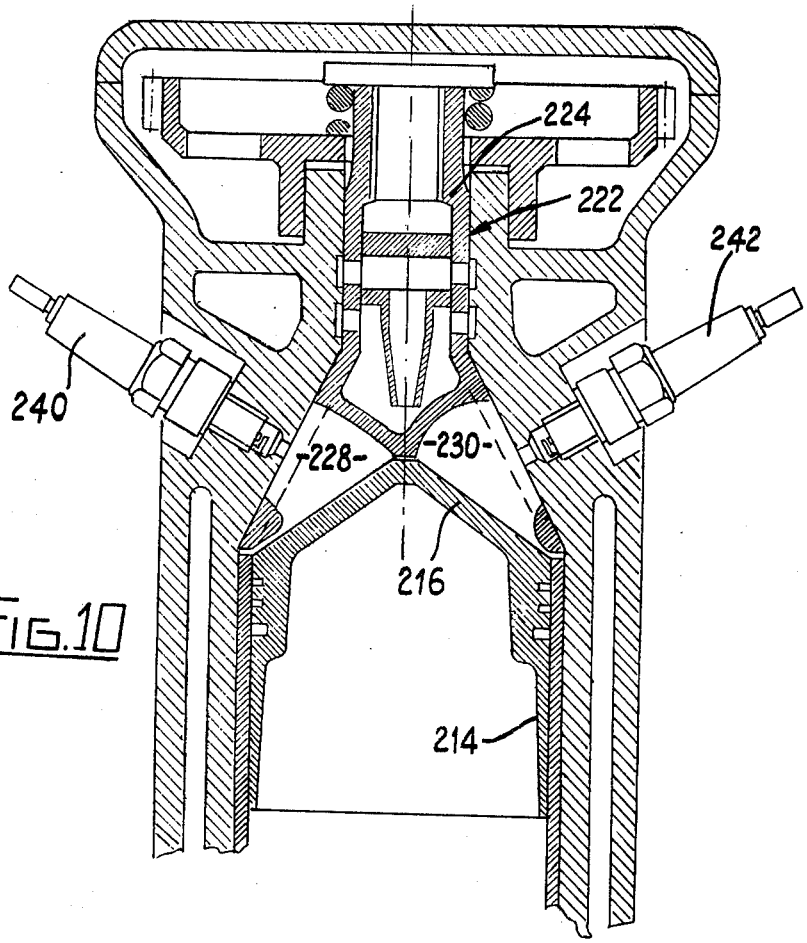
FIG. 10 is a sectional view similar to FIG. 4 but illustrating a modified valve rotor.
Figure 11:
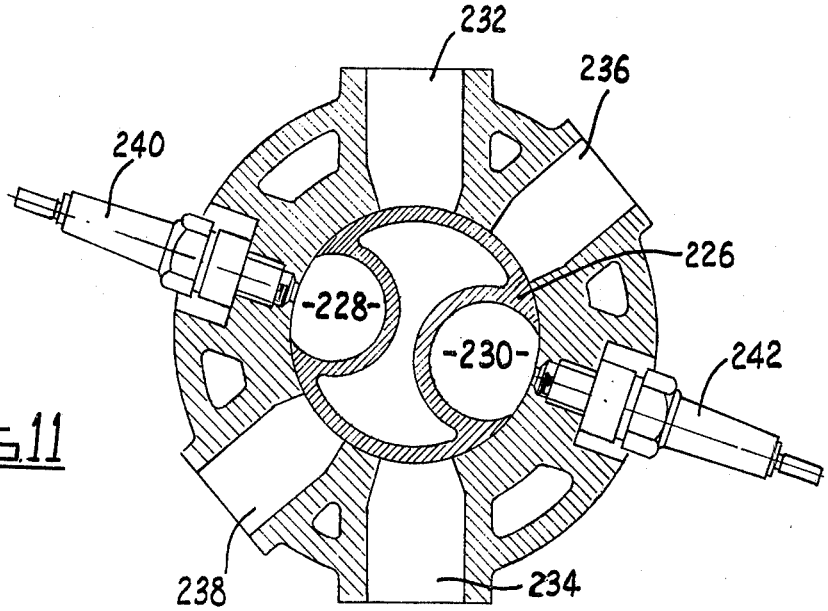
FIG. 11 is a sectional plan view corresponding to FIG. 10 showing the relationship of the valve rotor and the inlet and exhaust ports at T.D.C. following a compression stroke of the piston.

FIGS. 10 and 11 illustrate an embodiment which is again basically similar and corresponding parts are indicated by a 200 series of reference numerals. In this embodiment the volume of the passages 228, 230 through the valve rotor 222 are not equal. This enables the plugs 240, 242 to be fired simultaneously and achieve the same effect, hereinbefore mentioned, as with phased plug firing and equal passage volumes.

The invention is by no means restricted to the particular details of the embodiments just described. For example the speed of the valve rotor may be varied as described in British Pat. No. 1,228,156. Also, as already implied, various forms of valve driving gear, lubrication means, and cooling systems may be incorporated.

What is claimed is:

1. An internal combustion engine comprising:

a structural within which is defined at least one cylinder block accommodating a reciprocable piston having a crown, and within which is disposed a valve rotor mounted at the compression end of the, or each, cylinder for rotation about the longitudinal axis of the cylinder and having a number of valve rotor passages therethrough each extending between the cylinder interior and a portion of the structure having inlet and exhaust ports corresponding in number to the number of valve rotor passages, to allow for conventional four-stroke operation with said valve rotor rotating at an appropriate fraction of crank-shaft speed, the construction being such that at top dead centre following a compression stroke each valve rotor passage forms a substantially independently enclosed combustion space at the compression end of the cylinder adjacent the crown of the pistion, and a supply passage leading to and for supplying air only through at least one inlet port, and a supply passage leading to and for supplying a fuel and air mixture through at least one inlet port, the supply passage leading to each inlet port to which air only is fed being inclined so as to direct the air through the valve rotor to the cylinder walls whereas the supply passage leading to each inlet port to which a fuel and air mixture is fed is inclined so as to direct the fuel and air mixture through the valve rotor to the inner part of the cylinder.

2. An internal combustion engine as claimed in claim 1 in which the internal contours of said valve rotor passages are such that gases are admitted thereto from the inlet ports of the cylinder with a rapid swirling motion.

3. An internal combustion engine as claimed in claim 1 further comprising ignition means adapted to generate an ignition spark adjacent the boundary of each combustion space remote from the piston crown after compression of a fuel mixture in said space, and in which the internal contours of said valve rotor passages are such that on generation of said spark the propagation of combustion within each combustion space proceeds in a controlled and even manner.

4. An internal combustion engine as claimed in claim 1 in which said valve rotor has two similar and diametrically opposed valve rotor passages through a skirt portion having a frusto-conical outer surface, and in which there are two inlet ports and two outlet ports in a cylinder block which surrounds said valve rotor.

5. An internal combustion engine as claimed in claim 4 in which said skirt portion has a frusto-conical inner surface which is complementary to the surface of the piston crown.

6. An internal combustion engine as claimed in claim 5 in which each said valve rotor passage commences at the outer surface of said skirt portion with a trapezium cross-sectional shape and terminates at the inner surface of said skirt portion with a substantially circular cross-sectional shape, in both cases as viewed normally to the respective surface, and therebetween the valve rotor passage walls are smoothly curved to provide a maximum cross-sectional dimension at the inner surface of the skirt portion and a minimum cross-sectional dimension at the outer surface of the skirt portion.

7. An internal combustion engine as claimed in claim 1 in which the timing arrangements are such that ignition occurs at top dead centre.

8. An internal combustion engine as claimed in claim 1 in which the timing arrangements are such that ignition occurs in one combustion space in advance of ignition in another combustion space.

9. An internal combustion engine as claimed in claim 1 in which the volumes of the combustion spaces are different.

10. An internal combustion engine as claimed in claim 1 further comprising throttle control means adapted to vary the air-fuel ratio suitably according to load conditions to achieve fuel economy and reduction in unburnt hydrocarbons.

11. An internal combustion engine as claimed in claim 1 which further comprises cooling means capable of maintaining the surfaces of the combustion spaces at about two-thirds the temperature of the piston crown.

12. An automobile having a gasoline fueled internal combustion engine as claimed in claim 1.

* * * * *